United States Patent [19]

Kimura

[11] Patent Number: 4,651,141

[45] Date of Patent: Mar. 17, 1987

[54] ALARM AND CONTROL SYSTEM FOR SEMICONDUCTOR FACTORIES OR THE LIKE

[75] Inventor: Shoichi Kimura, Tokyo, Japan

[73] Assignee: Nohmi Bosai Kogyo Co., Ltd., Tokyo, Japan

[21] Appl. No.: 581,974

[22] Filed: Feb. 21, 1984

[30] Foreign Application Priority Data

Nov. 27, 1982 [JP] Japan ..... 57-205890

[51] Int. Cl.[4] ..... G08B 17/10

[52] U.S. Cl. ..... 340/634

[58] Field of Search ..... 340/632, 634; 422/98; 436/3; 427/86; 73/40.7

[56] References Cited

U.S. PATENT DOCUMENTS 4,000,089 12/1976 Senda ..... 73/27 R X
4,223,692 9/1980 Perry ..... 340/634 X
4,369,031 1/1983 Goldman et al. ..... 427/85 X
4,446,718 5/1984 Bukowiecki et al. ..... 340/634 X
4,490,715 12/1984 Kusanagi et al. ..... 340/634

FOREIGN PATENT DOCUMENTS 611204 12/1960 Canada ..... 340/632

*Primary Examiner*—James L. Rowland
*Assistant Examiner*—Brian R. Tumm
*Attorney, Agent, or Firm*—Nies, Webner, Kurz & Bergert

[57] ABSTRACT

An alarm and control system for semiconductor factories or the like wherein poisonous and inflammable treatment gases such as silane gas are used as in the manufacturing process of semiconductors, etc. is disclosed. Gas detecting means are provided at locations where the treatment gases are used, the gas detecting means utilizing metal oxide semiconductors containing platinum black as a detecting element for detecting the leakage of the treatment gases.

4 Claims, 2 Drawing Figures

ALARM AND CONTROL SYSTEM FOR SEMICONDUCTOR FACTORIES OR THE LIKE

BACKGROUND OF THE INVENTION

The present invention relates to an alarm and control system, and more particularly to an alarm and control system in semiconductor factories or the like which can detect a fire or the leakage of treatment gases which are generated during the manufacturing process in a very large-scale integration (LSI) factory and which also suitably controls the manufacturing process as well as a protection device such as fire extinguishing equipment.

In semiconductor factories for LSI's, etc., at the time of applying an isolation film to a silicon wafer, a silane gas is utilized. Such a treatment gas is dangerous not only because it poisonous, but also because when the concentration of the gas becomes 2 to 5% or more it reacts with oxygen in the air and burns. In fact, a fire which occurred in a certain LSI factory and brought about enormous losses was possibly caused by leakage of this gas.

SUMMARY OF THE INVENTION

It is a principal object of the present invention to provide an alarm and control system for semiconductor factories or the like which detects the presence of leaked treatment gases by gas detectors at such a low concentration that the gas does not ignite even if it comes into contact with oxygen in the air and which performs adequate control such as fire prevention.

In an alarm and control system in accordance with the present invention for semiconductor factories or the like wherein poisonous and inflammable treatment gases such as silane gas are used as in the manufacturing process of semiconductors, etc., gas detecting means are provided at locations where the treatment gases are used.

The gas detecting means utilize metal oxide semiconductors as a detecting element for detecting the leakage of the treatment gases, and the gas detecting means cause, upon a change in their output states, an alarm to issue and a protection device such as a fire extinguishing device as well as the manufacturing process to be controlled.

BRIEF DESCRIPTION OF THE DRAWINGS

This and other objects of the present invention will become more readily apparent upon reading the following description and upon reference to the accompanying drawings, in which.

DESCRIPTION OF A PREFERRED EMBODIMENT

Figure 1:
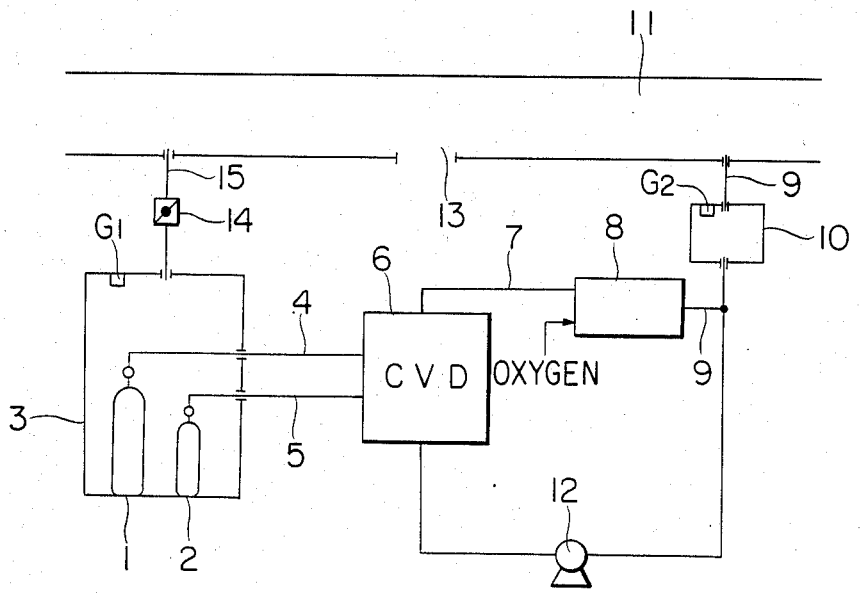
FIG. 1 is a schematic view of one embodiment of the present invention.

Reference is now made to FIG. 1 of the accompanying drawings wherein is shown one embodiment of the present invention as utilized in a CVD (Chemical Vapor Deposition) apparatus as well as associated apparatuses used at the time of applying an insulation film to a semiconductor wafer.

In FIG. 1, element number 1 is a silane gas cylinder, 2 is an ammonia gas cylinder, 3 is a housing to house these cylinders, 6 is a nitride film-forming device (CVD) to form an insulating film on a semiconductor wafer by supplying silane and ammonia gases through pipes 3 and 5, respectively, 8 is a scavenging device which forcedly oxidizes, i.e. treats by combustion the unreacted silane gas discharged from the device 6 through a pipe 7 with oxygen being supplied to the scavenging device, from which the treated silane gas is passed through a pipe system 9 to an exhaust duct 11. Component 10 is a detection box provided in the pipe system 9 to monitor the state of the gas to be discharged to an exhaust duct 11 from the scavenging device 8. Unit 12 is a vacuum pump to make the CVD 6 vacuous, 13 is a vent into duct 11 for room air, and 14 is a damper mounted in a pipe 15 connecting the housing 3 with the exhaust duct 11. Installed in the housing 3 and the detection box 10 are gas detectors $G_1$ and $G_2$, respectively, which detect the leakage of the treatment gases such as silane gas. As gas detectors $G_1$ and $G_2$, optical-type gas detectors which detect the light scattered by gas particles may be used.

However, a more appropriate gas detector comprises a CO detecting element such as disclosed in Japanese Patent Publication No. 14380/1980 after the element has been aged in an atmosphere of silane gas. The CO detecting element according to that invention is a metal oxide semiconductor containing platinum black in a stannic oxide composition. When aged in an atmosphere of silane gas, it can respond to a concentration of silane gas as low as 0.2 to 0.5%, and is therefore most suitable for use as a gas detector in the present invention.

Figure 2:
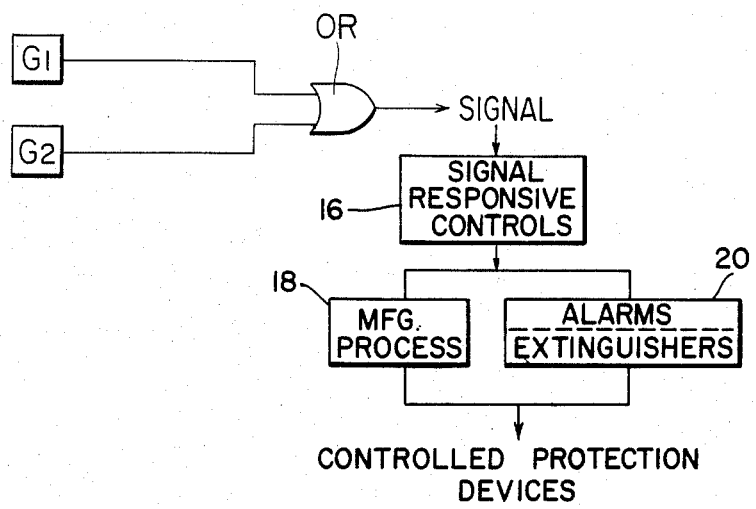
FIG. 2 is its circuit diagram.

The gas detectors $G_1$ and $G_2$ are connected to an OR-circuit OR as shown in FIG. 2, the output thereof being connected to a relay means control unit 16 which appropriately controls a protection device 18 and/or 20 such as a gas leakage alarm, a fire extinguishing device or the like, or which keeps the manufacturing process 18 of the semiconductors under control, shown as diagrammatic blocks in FIG. 2.

Operation of the apparatus described above is as follows.

The nitride film-forming (CVD) device 6 has semiconductor wafers contained therein, and after it is made vacuous by the vacuum pump 12, the silane and ammonia gas cylinders 1 and 2 are opened to supply the silane and ammonia gases to the device 6, whereby nitride films necessary for the semiconductor wafers, i.e. insulating films are generated thereon. The gases which are still unreacted after the treatment are forcibly oxidized in the scavenging device 8 and discharged into the exhaust duct 11 through the pipe system 9 as a harmless gas.

In this state, should silane gas leak from the silane gas cylinder 1 in an amount that is of a degree insufficient to react with oxygen in the air and burn, the gas detector $G_1$ detects the gas itself and its output state changes from off to on. This operates the relay means 16 through the OR-circuit OR, and the relay means controls the manufacturing process by operating the protection device such as a gas leakage alarm or a fire extinguishing device or by fully opening the damper 14 to discharge the leaked gas to the exhaust duct. As for the detection box 10, while the scavenging device 8 is normally operating, the products of combustion generated by the combustion of the treatment gases are discharged through the pipe 9 to the exhaust duct 11, so the gas detector $G_2$ does not operate. However, if the scavenging device 8 breaks down and the silane gas is ejected without being treated, the gas detector $G_2$ operates, and a protection device such as a gas leakage alarm, a fire extinguishing device, etc. 20 or a relay means to control the manufacturing process 18 is operated through the OR-circuit OR.

As stated above, the present invention provides an alarm and control system for semiconductor factories or the like at locations where poisonous and inflammable treatment gases such as silane gas are used in the manufacturing process of semiconductors, etc. so that the existence of leaked treatment gases can be detected by gas detectors while the concentration of the leaked treatment gases is at such a low degree that the gas cannot react with oxygen in the air to burn and appropriate control can be carried out before a fire breaks out.

Although a single embodiment of the present invention has been described above and illustrated herein, it should be understood that various changes and modifications in form and arrangement of parts may be made without depending from the spirit and scope of the present invention.

What is claimed is:

1. An alarm and control system for semiconductor factories or the like having an exhaust system wherein treatment gases including silane gas are used in the manufacturing process of semiconductors, or the like comprising: gas detecting means, provided at the locations where said treatment gases are used, which utilize a metal oxide semiconductor containing platinum black as a detecting element for detecting the leakage of said treatment gases, including silane gas, any said metal oxide semiconductor used as said detecting element, which contains said platinum black, is aged in an atmosphere of silane gas; said gas detecting means having circuitry means which, upon a change in the output state of said metal oxide semiconductor, cause an alarm signal to issue; and means responsive to said alarm signal connected to control a protection device such as a fire extinguishing device as well as said manufacturing process of semiconductors or the like.

2. An alarm and control system for semiconductor factories or the like as claimed in claim 1 wherein said gas detecting means, at least in part, are installed in said exhaust system.

3. An alarm and control system for semiconductor factories or the like as claimed in claim 1 wherein a housing is provided wherein cylinders of treatment gases including silane gas are housed, and said gas detecting means are installed in said housing.

4. An alarm and control system for semiconductor factories or the like as claimed in claim 3, including as a protection device for the manufacturing process: a normally closed by-pass fluid communication passage means between said housing and said exhaust system; and means, included in said by-pass fluid communication passage means and responsive to said detecting means causing an alarm signal to issue, to open said by-pass fluid communication passage means.

* * * * *